US006108511A

United States Patent [19]

Kutsuwada et al.

[11] Patent Number: 6,108,511

[45] Date of Patent: Aug. 22, 2000

[54] TONER COLLECTING AND REUSING DEVICE FOR USE IN AN IMAGE FORMING APPARATUS AND A METHOD THEREOF

[75] Inventors: Akio Kutsuwada, Kawasaki; Seiji Oka; Tetsuo Yamaoka, both of Yokohama; Keisuke Hayashi; Shinji Tamaki, both of Tokyo-to, all of Japan

[73] Assignee: Ricoh Company, Ltd., Tokyo, Japan

[21] Appl. No.: 09/289,961

[22] Filed: Apr. 13, 1999

[30] Foreign Application Priority Data

Apr. 13, 1998 [JP] Japan ..... 10-117796

[51] Int. Cl.[7] ..... G03G 21/10

[52] U.S. Cl. ..... 399/359; 399/253

[58] Field of Search ..... 399/98, 253, 358, 399/359, 360; 209/261, 262, 315

[56] References Cited

U.S. PATENT DOCUMENTS 5,600,411 2/1997 Hart ..... 399/98

5,950,062 9/1999 Yahata et al. ..... 399/358

FOREIGN PATENT DOCUMENTS 56-27186 3/1981 Japan .

58-158675 9/1983 Japan .

8-87164 4/1996 Japan .

10-260583 9/1998 Japan .

10-293461 11/1998 Japan .

*Primary Examiner*—Joan Pendegrass

*Attorney, Agent, or Firm*—Oblon, Spivak, McClelland, Maier & Neustadt, P.C.

[57] ABSTRACT

An image forming apparatus including a plurality of filters for obtaining reusable toner from used toner scraped off of an image carrier. Also included is a reusable toner container for storing the reusable toner, and a toner transfer device for transferring the reusable toner stored in the reusable toner container to a developing device so that the reusable toner is reused by the developing device. The plurality of filters have a different mesh-size and are positioned in a used toner stream in an order based on the different mesh-size.

34 Claims, 9 Drawing Sheets

TONER COLLECTING AND REUSING DEVICE FOR USE IN AN IMAGE FORMING APPARATUS AND A METHOD THEREOF

BACKGROUND OF THE INVENTION

1. Field of the Invention

This invention relates to a toner collecting and reusing device for use in an image forming apparatus, such as a copier, a facsimile, a printer, and so on. More particularly, this invention relates to a toner collecting and reusing device having an improved efficiency of collecting toner from a cleaning device of the image forming apparatus.

2. Discussion of the Background Art

As described in the Japanese Patent Application Laid Open No. 62-144191, for example, a conventional toner collecting and reusing device for use in an image forming apparatus generally includes a toner collecting path starting from a cleaning device and ending at a developing device of the image forming apparatus. The toner collecting path guides used toner collected by the cleaning device to the developing station so that the used toner may be reused. The conventional toner collecting and reusing device further includes a filter disposed on the toner collecting path, which separates reusable toner from a foreign substance, such as a paper powder, coagulated toner, and so on.

However, a mesh of the filter tends to get clogged with the used toner, because the mesh is generally small enough in size to allow only reusable toner to pass through. In particular, the toner tends to get clogged when a large amount of the used toner is to pass through the filter at once. Thus, the filter can not efficiently separate reusable toner from the foreign substance.

SUMMARY OF THE INVENTION

Therefore, an object of the present invention is to address and resolve the above-identified and other problems and provide a novel image forming apparatus.

According to the invention, the above and other objects are achieved by providing an image forming apparatus including a plurality of filters configured to filter off (i.e., separate) a foreign substance and so on from the used toner scraped off of an image carrier. Thus, reusable toner is obtained. Also included is a reusable toner container that stores the reusable toner, and a used toner transfer device that transfers the reusable toner from the reusable toner container to a developing device so that the reusable toner is reused by the developing device. In addition, the plurality of filters respectively have a different sized mesh and are positioned in a used toner stream in an order based on a roughness of the mesh. The plurality of filters may be positioned where the used toner scraped off of the image carrier falls due to gravity. Further, the plurality of filters may also have about a same width as a cleaning device, and include a toner pooling portion that provisionally pools the used toner. The toner pooling portion may include a concave portion or a horizontal portion connected with a slant portion, extending in a widthwise direction.

In another embodiment, an image forming apparatus includes a foreign substance storing device that receives at least a foreign substance blended in the used toner, which has not passed through the filters. The foreign substance storing device may be disposed beside and below the plurality of filters, and be independently removable from the image forming apparatus. In addition, the plurality of filters respectively incline downward to the foreign substance storing device.

In still another embodiment, the reusable toner container may include a toner ejecting opening at its bottom portion, which allows the reusable toner to be ejected. The bottom of the reusable toner container may incline downward to the toner ejecting opening. Further, a toner transfer device may include a toner carrying member that receives the reusable toner fallen through the toner ejecting opening and transfers the same to the developing device.

In yet another embodiment, a shaking device may shake the plurality of filters and/or the reusable toner container.

In still another embodiment, a toner pressing device may press the used toner against the filter during a toner filtering operation. The toner pressing device may include a toner pressing member that moves up and down during the toner filtering operation, and which presses the used toner against the filter when moved downward. The toner pressing member may include a hollow cylinder and a cam that rotates around its axis and contacts an inner surface of the hollow cylinder. The hollow cylinder may press the used toner when a shorter diameter of the cam contacts the inner surface.

DESCRIPTION OF THE PREFERRED EMBODIMENTS

Hereinbelow, embodiments of the present invention are explained referring to the several drawings. Like numbers and marks indicate identical or corresponding parts throughout the several views.

Figure 1:
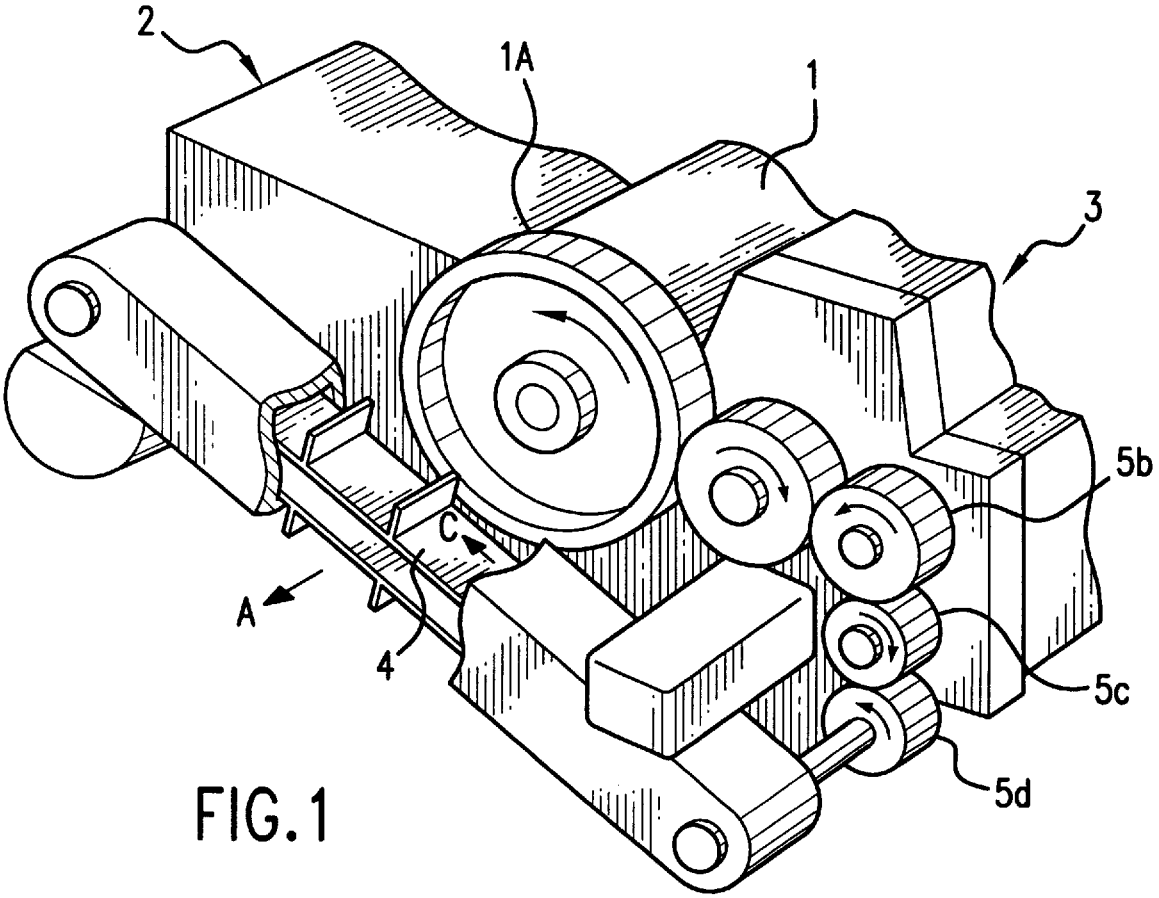
FIG. 1 is a schematic perspective view that illustrates an outline of a construction of a toner collecting and reusing device of the present invention.

FIG. 1 illustrates a schematic construction of one embodiment of an image forming apparatus having a toner collecting and reusing device of the present invention. FIG. 1 illustrates a side portion of the image forming apparatus when viewed in its longitudinal direction. An arrow A shows a front side direction of the image forming apparatus.

First, an outline of the image forming apparatus employing the toner collecting and reusing device is explained referring to FIG. 1. The image forming apparatus includes a photoconductive drum 1 (hereinafter referred to as a PC drum 1) to be rotated in a prescribed direction. The image forming apparatus further includes a conventional discharge device, an exposing optical device and a transferring/separating device (not shown), each disposed around the PC drum 1 for executing a conventional electrophotographic process. A developing device 2 is disposed substantially in parallel with the PC drum 1 at a left side of the PC drum 1.

A toner image formed on the surface of the PC drum 1 is transferred onto a sheet (not shown) at a transfer station. The toner image on the PC drum 1 is generally not completely transferred onto the sheet (i.e., a 100% of the toner image is not transferred). That is, some toner (e.g., about 10 to 20%) generally remains on the surface of the PC drum 1 after the toner transfer operation. Therefore, a cleaning device 3 is disposed at a right side of the PC drum 1 to remove the toner remaining on the surface. In addition, a casing that covers the cleaning device 3 is disposed in parallel with the PC drum 1.

A toner transfer belt 4 is provided near a rear surface of a front cover of the image forming apparatus. The toner transfer belt 4 may transfer only reusable toner among the used toner collected by the cleaning device 3 to the developing device 2, when driven in a direction as indicated by an arrow C in FIG. 1. A PC driving gear 1*a* and a plurality of gears 5*a,* 5*b,* 5*c* and 5*d* meshing with each other are employed so that the gears 5*a,* 5*b,* 5*c* and 5*d* may transmit a rotational force of the PC driving gear 1*a* to the toner transfer belt 4. The toner transfer belt 4 transfers the reusable toner to the developing device 2.

The cleaning device 3 and a filter for filtering off a foreign substance, such as a paper powder, coagulated toner and so on blended in the used toner may form the toner collecting and reusing device. Further, the toner transfer belt 4 may form the toner collecting and reusing device.

Figure 2:
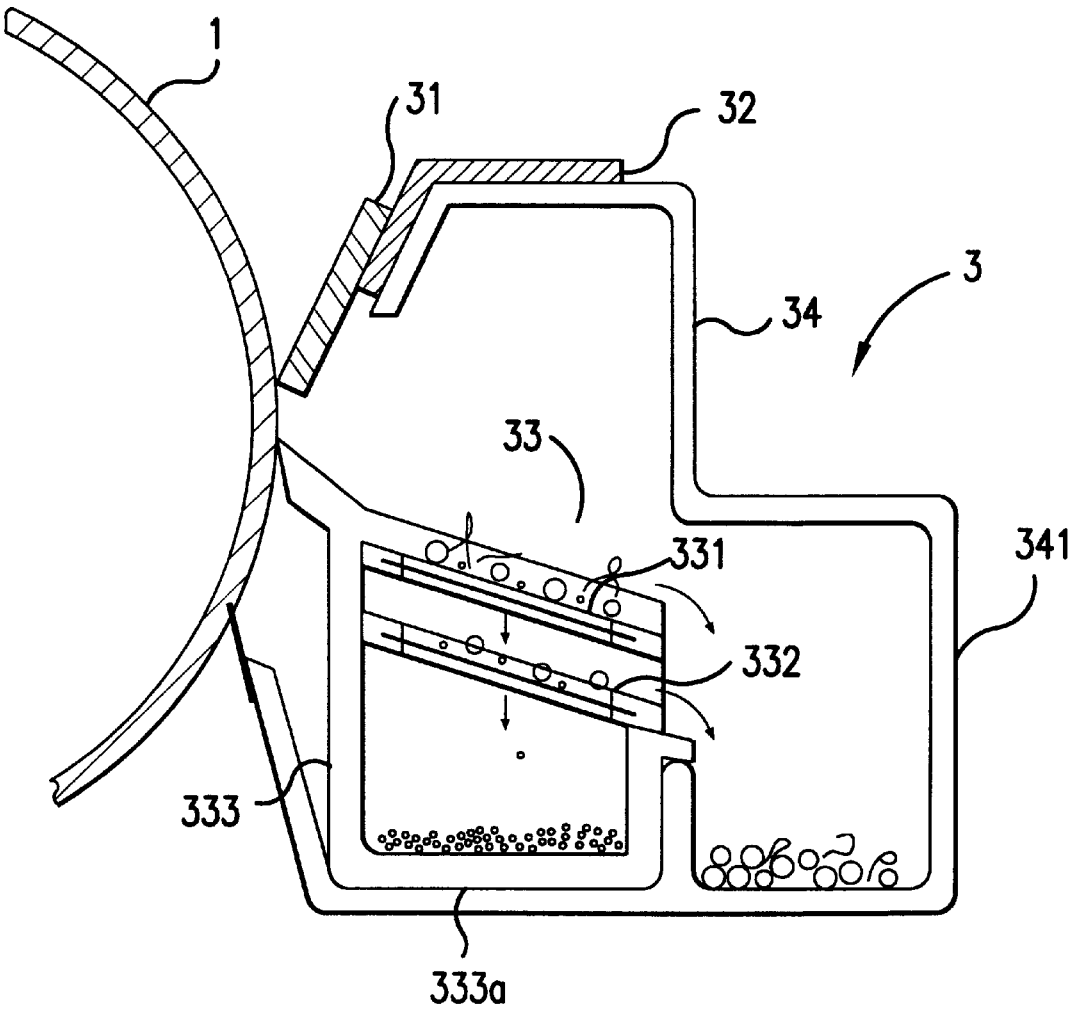
FIG. 2 is a schematic sectional view that illustrates a construction of an inside of a cleaning device of the toner collecting and reusing device illustrated in FIG. 1.

FIG. 2 illustrates a structure of an inside of the cleaning device 3. The casing 34 of the cleaning device 3 includes an opening at its left side (as viewed when looking at the drawing), which opposes the PC drum 1. A blade holder 32 is secured to an upper portion of the casing 34 by, for example, a screw. A cleaning blade 31, which removes residual toner remaining on the PC drum 1 by contacting the PC drum 1 with its one edge, is connected to the blade holder 32 through its other edge. The other edge may be bonded with the blade holder 32.

A shaking unit 33 is disposed at a position where the used toner scraped off of the PC drum 1 by the cleaning blade 31 falls due to gravity. The shaking unit 33 includes a pair of filters 331 and 332 for filtering off the foreign substance blended in the used toner. The pair of filters 331 and 332 are also disposed where the used toner falls. In addition, the pair of filters 331 and 332 have a mesh different in size from each other. The shaking unit 33 further includes a unit casing 333 that supports the pair of the filters 331 and 332, and a reusable toner collecting room 333*a,* which stores the reusable toner filtered by the pair of filters 331 and 332. The reusable toner collecting room 333*a* laterally extends, and its one end is positioned almost above the toner transfer belt 4. Further, the reusable toner collecting room 333*a* has a toner ejecting opening at its bottom portion of the front side, in which the reusable toner is ejected by gravity onto the toner transfer belt 4.

The filter 331 (hereinafter referred to as a first filter 331) has a relatively rough mesh and is disposed above the filter 332 (hereinafter referred to as a second filter 332) having a relatively fine mesh. The mesh of the first filter 331 has a size of about 100 $\mu$m so that the foreign substance having more than about 100 $\mu$m is filtered off and remains thereon, and the toner having a diameter less than that can pass through the mesh to the second filter 332.

In addition, the mesh of the second filter 332 has a size larger than a diameter of a reusable toner and less than about 50 $\mu$m, so that a foreign substance having more than about 50 $\mu$m is filtered off and remains thereon. Thus, the used toner having the diameter less than that can pass through the mesh to fall onto the reusable toner collecting room 333*a*.

Thus, the foreign substance blended in the used toner may be filtered off in an order based on the mesh size of the filters. Therefore, because the used toner does not try to pass through a filter at once, and passes through the first and second filters 331 and 332, which are in an order based on a roughness of the mesh (i.e., mesh-size), the first and second filters 331 and 332 are not clogged with the used toner. Further, since the first and second filters 331 and 332 are positioned where the used toner scraped off of the PC drum 1 directly falls, an extra step for leading the used toner to the filters can be omitted. Thus, the image forming apparatus can be made compact, even though the foreign substance container portion 341 is disposed in the unit casing 333.

In addition, the first and second filters 331 and 332 laterally extend below the cleaning blade 31 in parallel with an axis of the PC drum 1. Further, the first and second filters 331 and 332 are configured to have almost a same width as the cleaning blade 31 to receive the used toner along the width. Thus, an amount of used toner passing through the filters per a unit area may be less than when filters are used whose width is smaller than the cleaning blade 31. Consequently, a fine toner may be separated without the used toner becoming jammed, and the reusable toner having a prescribed particle diameter can be efficiently collected and reused. Accordingly, an abnormal toner image can be avoided.

In addition, a foreign substance container portion 341 is disposed at a right side of the shaking unit 33 beside the first and second filters 331 and 332 with the casing 34. The foreign substance container portion 341 stores the foreign substance not passed through the first and second filters 331 and 332. Since the foreign substance container portion 341 is positioned beside the first and second filters 331 and 332, a toner transfer path between the cleaning station and the foreign substance container portion 341 can be relatively short, and accordingly, an extra space in the cleaning device 3 can be omitted.

Both the first and second filters 331 and 332 may incline downward to the foreign substance container portion 341, such that their left side ends are higher than their right side ends (as shown in FIG. 2). Thus, the used toner scraped off of the PC drum 1 by the cleaning blade 31 descends and passes through the first filter 331 and the second filter 332, respectively, by gravity and then enters into the reusable toner collecting room 333*a*. Similarly, the filtered foreign substance, which did not pass through both filters, falls into the foreign substance container portion 341.

The used toner collecting and reusing device further includes a shaking generator configured to apply a shaking movement to the shaking unit 33. The shaking generator is explained below in detail referring to FIGS. 3, 4 and 5.

Figure 4:
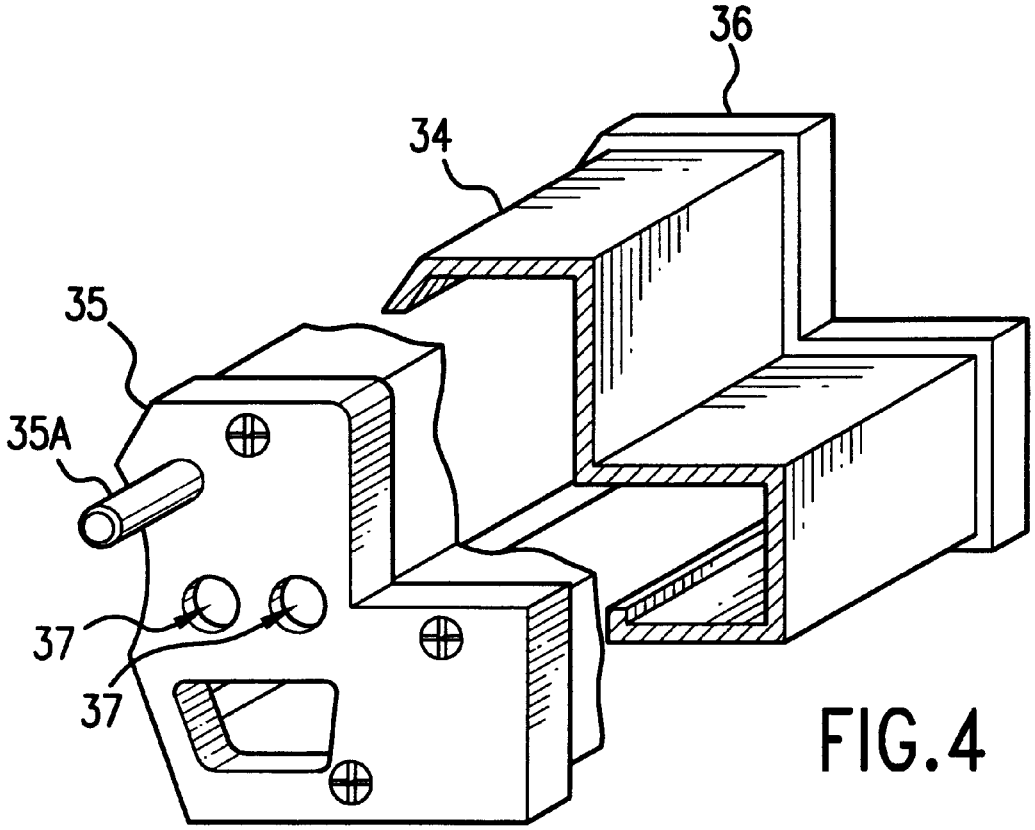
FIG. 4 is a schematic perspective view that illustrates a housing of the shaking device illustrated in FIG. 3.
Figure 5:
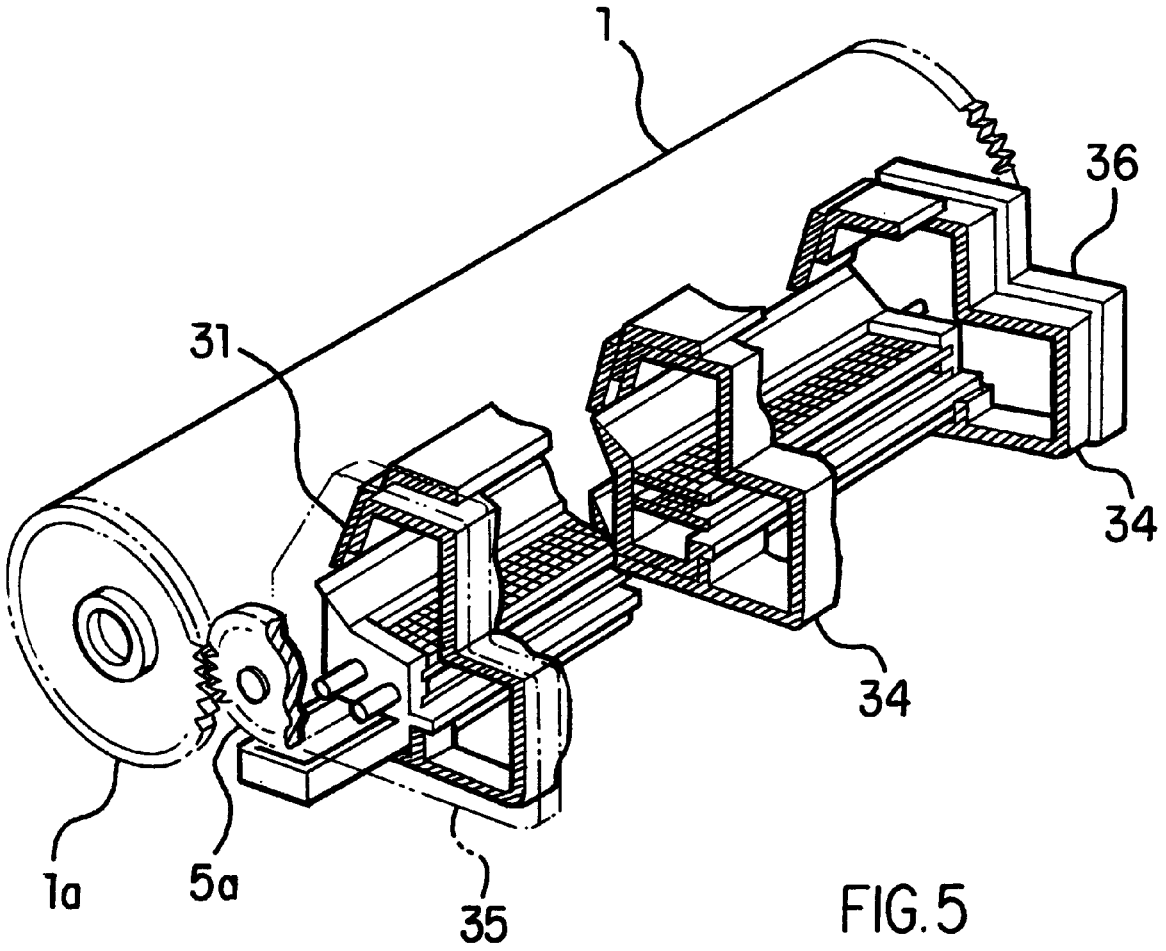
FIG. 5 is a schematic perspective view that illustrates a mechanism of the shaking device illustrated in FIG. 4.

The shaking unit 33 is movably supported by the cleaning device 3 in parallel with the axis of the PC drum 1. The shaking unit 33 may include two pairs of pins 334, each pair respectively disposed at side end walls of the shaking unit 33, such that each pin laterally protrudes from the respective side end walls. The two pair of pins 334 are inserted into two pair of holes 37, respectively formed on both a front side plate 35 and a rear side plate 36 of the cleaning device 3, as illustrated in FIG. 4. Thus, as illustrated in FIG. 5, the shaking unit 33 can be moved in a longitudinal direction within a housing formed by the casing 34, the front side plate 35 and the rear side plate 36.

In addition, both the front and rear side plates 35 and 36 are secured to side ends of the casing 34 by, for example, screws. A compression spring 335 is loosely wound around one of the pins 334, which is positioned at the rear side of the housing. An end of the compression spring 335 is secured to a predetermined portion of the cleaning device 3. Thus, the compression spring 335 always pushes the shaking unit 33 toward the front side of the cleaning device 3.

The shaking unit 33 may be attached to the cleaning device 3 as follows. First, the plurality of pins 334 may be separately equipped from the shaking unit 33. The operator may locate the shaking unit 33 at a prescribed inner portion of the cleaning device 3, and keep the shaking unit 33 floated therein by hand. The operator then respectively penetrates the two pairs of pins 334 through both the front and the rear side plates 35 and 36 from an outside of the shaking unit 33. The operator then secures the two pair of the pins 334 to both the front and the rear side walls by screwing or pressure inserting, for example.

Figure 3:
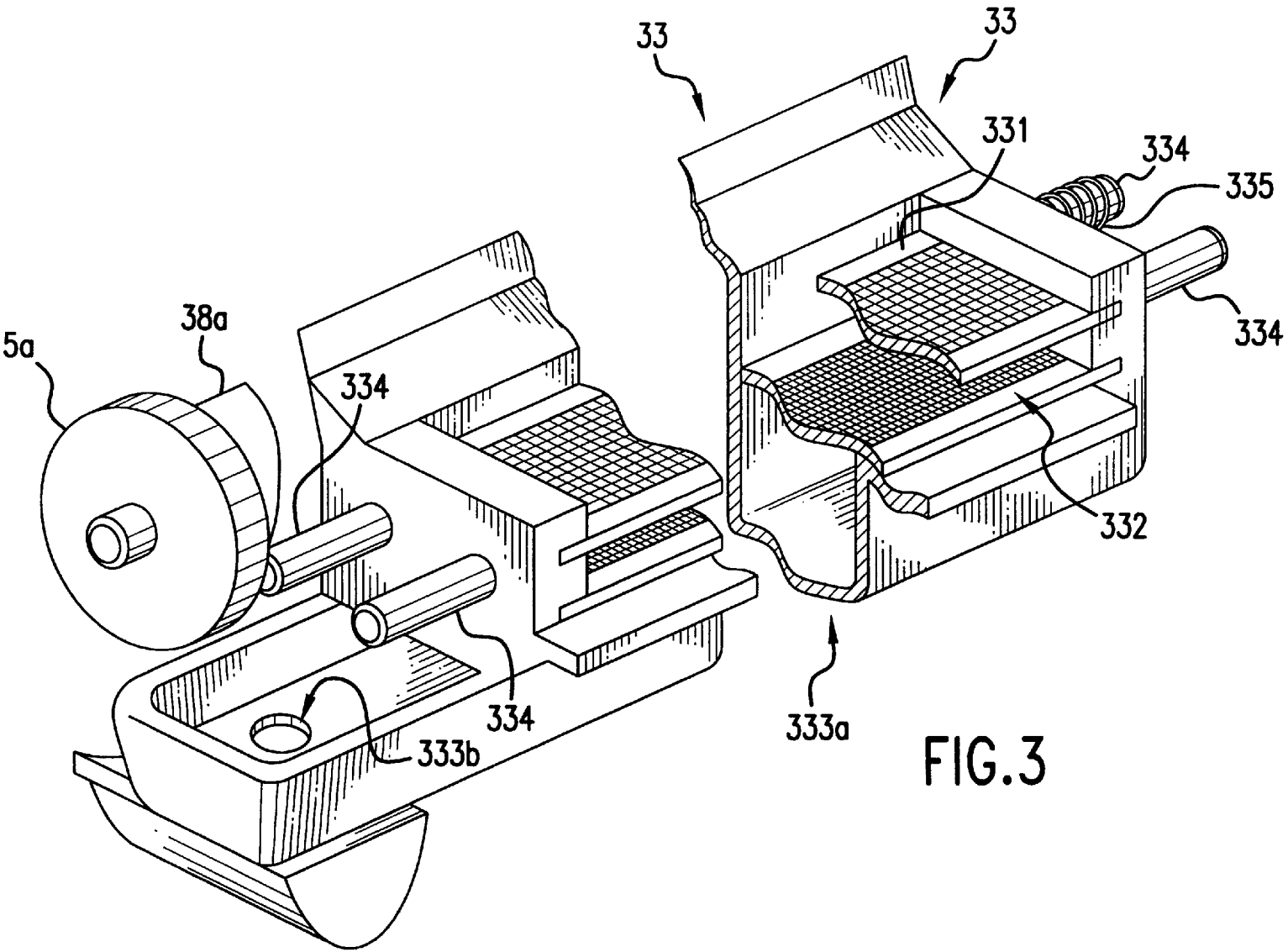
FIG. 3 is a schematic perspective view that illustrates a shaking device for shaking the cleaning device illustrated in FIG. 2.

As illustrated in FIG. 4, the cleaning device 3 includes a shaft 35*a* fixedly mounted on its front side plate 35. The shaft 35*a* laterally protrudes from the front side plate 35. As illustrated in FIG. 3, the gear 5*a* is mounted around an end of the shaft 35*a* and may include a cam portion 38*a*. The cam portion 38*a* is positioned to always contact a leading end of one of the pins 334 disposed at the front side of the shaking unit 33. A shape of the cam portion 38*a* is configured to move the shaking unit 33 back and forth when the gear 5*a* rotates. In addition, the cam portion 38*a* may include different diameters to sharply change a moving distance of the shaking unit 33 when the cam portion 38*a* is rotated.

Since the compression spring 335 always biases the shaking unit 33 toward the front side of the cleaning device 3, the shaking unit 33 moves to the front side and abuts against the front side wall 35 of the cleaning device 3 when a shortest diameter portion of the cam portion 38*a* contacts the leading end of the pin 334. Thus, a vibration of the shaking unit 33 may be created by the cam portion 38*a* and the compression spring 335.

The vibration may promote the above-mentioned fall of the larger toner and the foreign substance from the first and second filters 331 and 332 to the foreign substance container portion 341. Therefore, a filtering efficiency can be improved. Also, the vibration creates a movement of the reusable toner stored in the reusable toner collecting room 333*a* toward a front side of the reusable toner collecting room 333*a*, because of the slight inclination downward to the front side.

The reusable toner moved to the front side may then fall down (i.e., ejected) through the toner ejecting opening 333*b*. Thus, a friction generally applied to the reusable toner by a wall of the reusable toner container room 333*a* during transportation of the reusable toner may be minimized more than when the reusable toner is transferred by a toner transfer mechanism such as a screw and so on. Further, the toner does not coagulate on the toner collecting path. The reusable toner ejected through the toner ejecting opening 333*b* is received by a toner transfer belt 4, and then transferred to the developing device 2.

A modification of the present invention will now be explained referring to FIG. 6. Since almost all of the toner scraped off of the PC drum 1 may be reusable, the foreign substance container portion 341 can be relatively small.

However, if a life time of the cleaning blade 31 is longer than a period it takes to fill the foreign substance container portion 341, when the foreign substance container portion 341 can afford to store more foreign substance, the cleaning device requires to be forcibly exchanged with a new one when the foreign substance container 341 is filled, even if the cleaning blade 31 is still durable. Further, when the cleaning device 3 is included as a process cartridge detachably mounted in the image forming apparatus, which includes at least a PC drum 1 and if a life time of the PC drum 1 is longer than a period required to fill the foreign substance container portion 341, the PC drum 1 requires to be forcibly exchanged with a new one whenever the foreign substance container is filled, even if the PC drum 1 is still durable.

To avoid such problems, a capacity of the foreign substance container portion 341 can be increased, for example, corresponding to an increase of the life times of the cleaning blade 31 and the PC drum 1. However, the image forming apparatus may become bulky. Thus, the foreign substance container portion 341 is preferably configured to be detachably mounted on the cleaning device 3.

Figure 6:
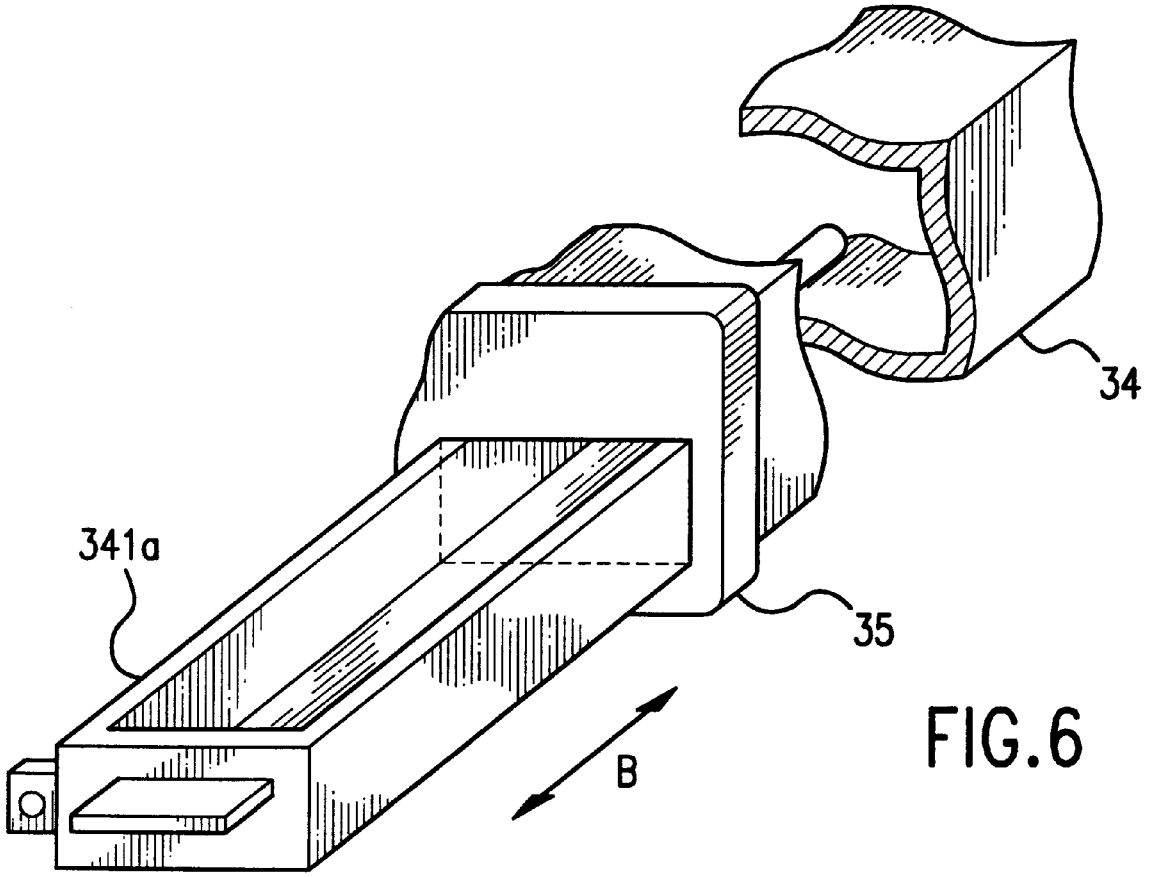
FIG. 6 is a schematic perspective view that illustrates a modification of a foreign substance collecting portion of the cleaning device illustrated in FIG. 2.

FIG. 6 illustrates one example of the foreign substance container portion 341, which includes a foreign substance case 341*a* mounted on the cleaning device 3. The case 341*a* is capable of sliding in a direction as indicated by an arrow B. The foreign substance case 341*a* may be exchanged with a new one, whenever it becomes filled.

Further, the foreign substance case 341*a* can be reused by discarding the foreign substance contained in the case. Thus, both the cleaning device and the process cartridge can be kept small. Further, the foreign substance case 341*a* prevents the premature changing of the blade 31 and PC drum 1 without making the device larger.

Figure 7A:
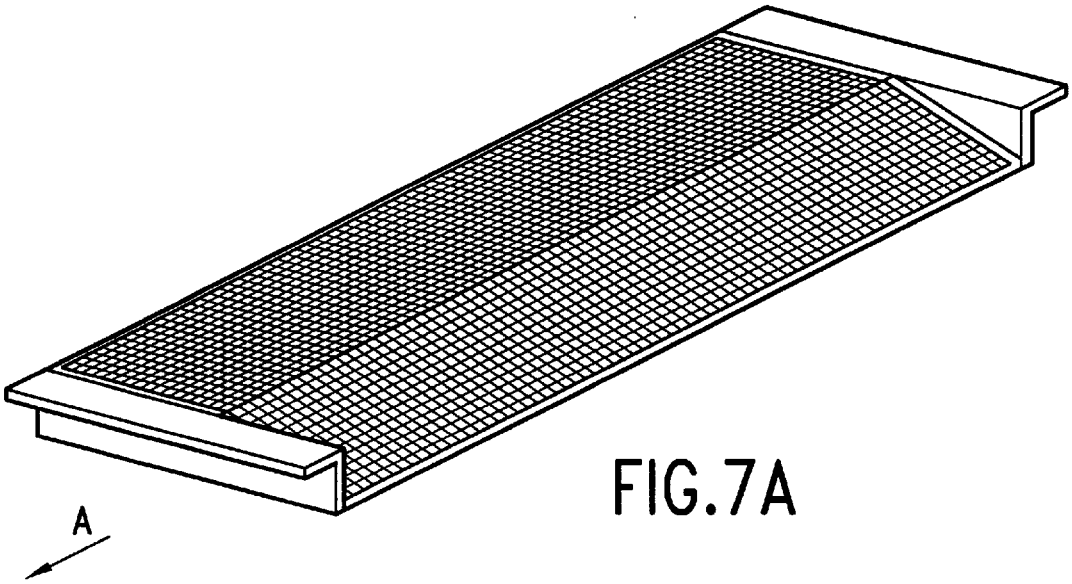
FIGS. 7A and 7B are schematic perspective views that illustrate filters each having a non flat portion, that are used in the cleaning device illustrated in FIG. 2.
Figure 7B:
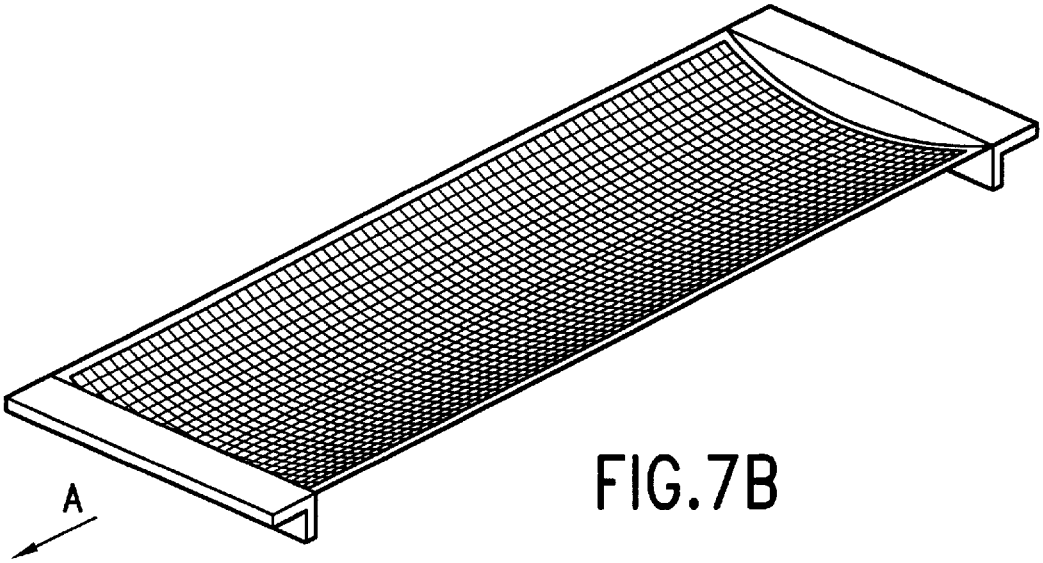

Another modification of the present invention will now be explained referring to FIGS. 7A and 7B. FIGS. 7A and 7B illustrate examples of the first and second filters 331 and 332. As shown, the filters 331 and 332 are configured to provisionally pool the used toner scraped off of the PC drum 1. A first example, illustrated in FIG. 7A, may include a horizontal portion for receiving the used toner, and a slant portion disposed beside the horizontal portion, which inclines downward to a bottom portion of the cleaning device 3. Thus, the horizontal portion may provisionally pool the toner thereon.

A second example of the filter, illustrated in FIG. 7B, may include a concave portion extending along a longitudinal direction of the filter. The concave portion may be configured to provisionally pool the used toner therein. If an inclined filter is entirely flat, and a great amount of the used toner falls thereon at once, almost all of the used toner may fall to the foreign substance container portion 341 without passing through the filter. As a result, the filter can not exert its function as expected.

However, according to the above-mentioned examples, since the used toner may be provisionally pooled on the filter, and the vibration as mentioned earlier is applied thereto, the filter may sufficiently function. Thus, reusable toner can be efficiently separated from the foreign substance.

Figure 8:
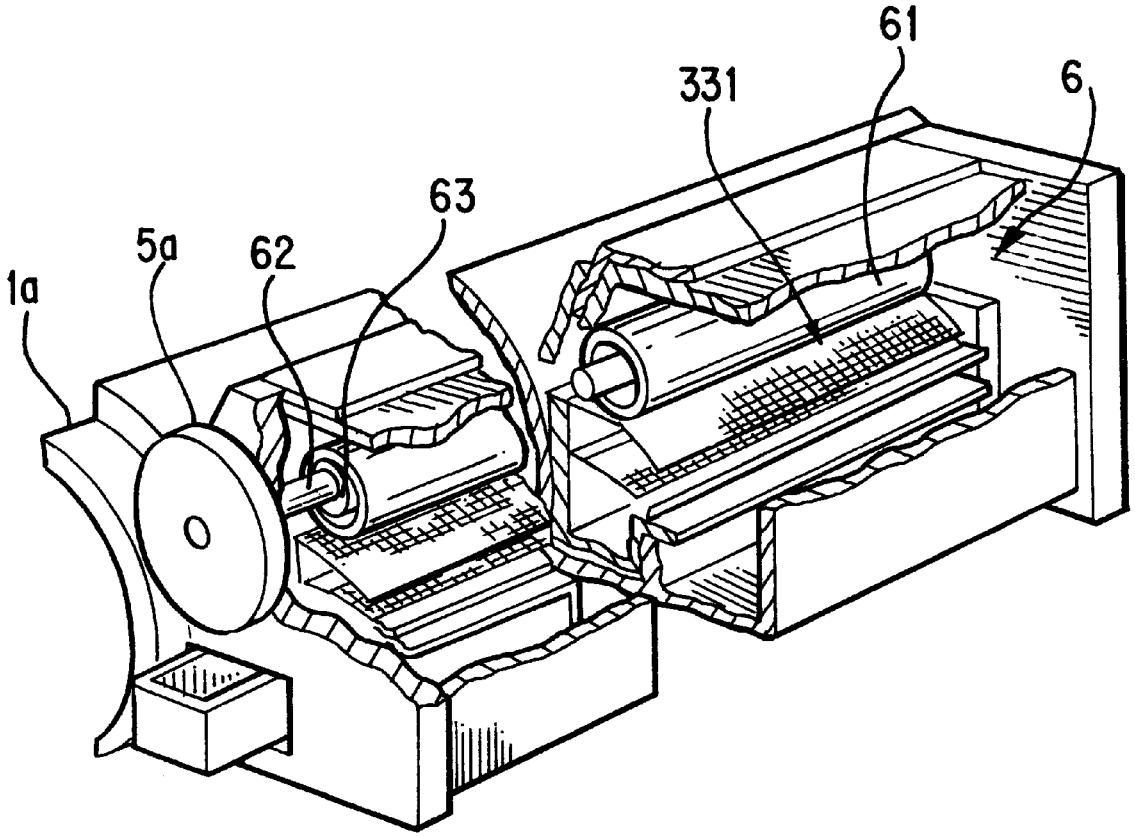
FIG. 8 is a schematic perspective view that illustrates a modified toner collecting and reusing device having a toner pressing member.

Still another modification will now be explained referring to FIGS. 8 and 9. FIG. 8 illustrates a modification of the toner collecting and reusing device having a shaking unit 33.

As shown, the modified toner collecting and reusing device includes a toner pressing member 6 for pressing toner pooled on the first filter 331. The toner pressing member 6 may include a long hollow cylindrical member 61 for pressing the used toner with its own weight. The toner pressing member 6 may also include a pair of supporting cams 63, each coaxially mounted on a rotation shaft 62 with the gear 5*a* at both ends of the rotation shaft 62, respectively. The pair of supporting cams 63 supports the hollow cylinder 61 thereon. The hollow cylindrical member 61 may be inhibited from moving in a thrusting direction by a stopper (not shown). The supporting cams 63 may rotate around their axis and contact the inner surface of the cylindrical member 61. Thus, when the gear 5*a* rotates, and accordingly the supporting cams 63 rotate, the cylindrical member 61 moves both up and down.

This is because a distance between the rotational shaft 62 and a contact portion of the cam surface contacting the inner surface of the cylindrical member 61 varies depending on a diameter of the supporting cams 63, when the supporting cam 63 rotates. The cylindrical member 61 almost contacts and then separates from the first filter 331 during its up and down movement. The cylindrical member 61 may press the used toner pooled on the first filter 331 when its moved downward.

Figure 9:
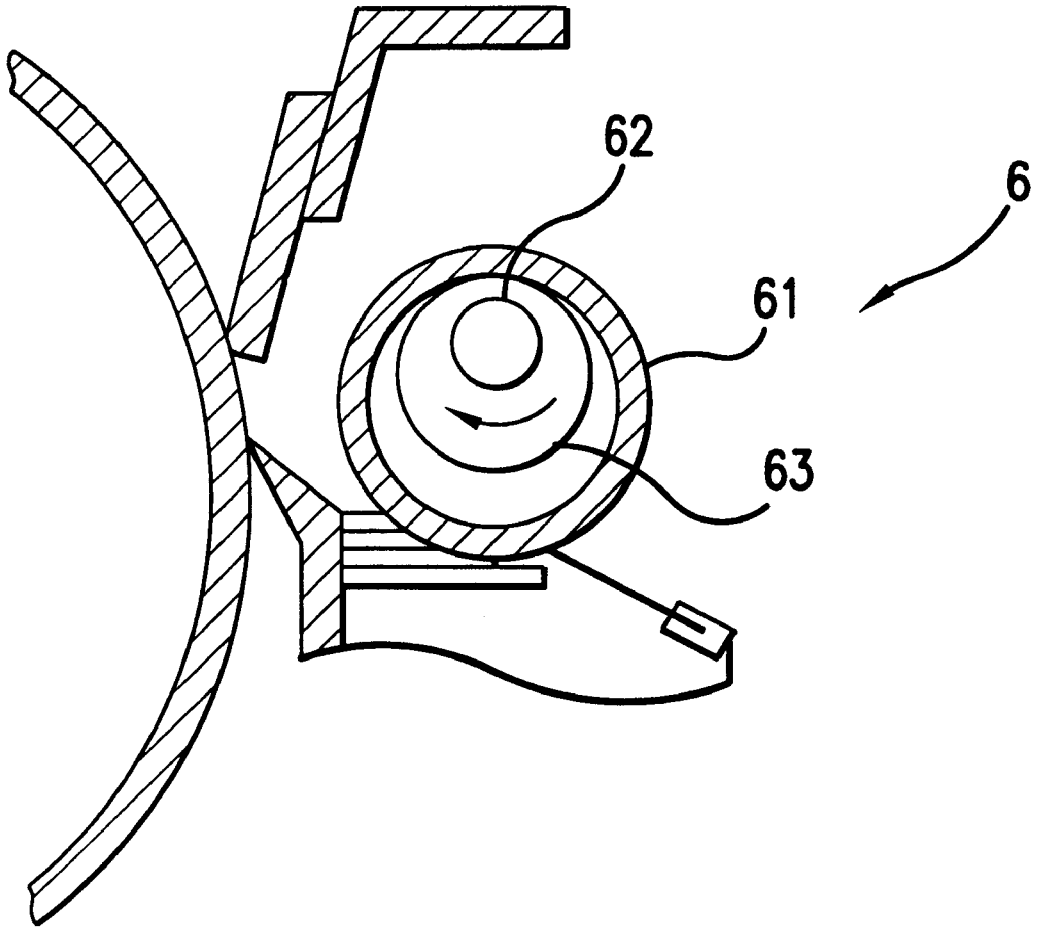
FIG. 9 is a schematic sectional view that illustrates the modified toner collecting and reusing device illustrated in FIG. 8.

FIG. 9 illustrates a status of the cylindrical member 61. As shown, the cylindrical member 61 may be at its lowest position due to a contact of the shortest diameter of the supporting cam 63 contacting the inner surface of the cylinder 61. Thus, the up and down movement of the cylindrical member 61 may press the used toner pooled on the first filter 331 so that the reusable toner easily passes through the first filter 331. Since an amount of the toner passing through the filter per a unit time may increase due to the up and down movement, toner clog can be avoided, and an efficient filtering operation may be obtained. The above-mentioned cylindrical member 61 can also be only or additionally disposed on the second filter 332.

Obviously, numerous additional modifications and variations of the present invention are possible in light of the teachings. It is therefore to be understood that within the scope of the appended claims, the present invention may be practiced otherwise than as specifically described herein.

The present application is based on Japanese priority document 10-117796, the contents of which are incorporated herein by reference.

What is claimed is:

1. An image forming apparatus, comprising:

an image carrier that carries a latent image thereon;

developing device that develops said latent image with toner so as to form a toner image;

a transfer device that transfers the toner image onto a sheet;

a cleaning device that removes used toner remaining on the image carrier after the transfer device transfers the toner image;

a plurality of inclined filters having a different mesh-size and positioned in a used toner stream in an order based on the different mesh-size, so that reusable toner is separated from a foreign substance blended in the used toner, and in which at least one filter of the plurality of filters includes a toner pooling portion that pools the used toner therein;

a reusable toner container that stores the reusable toner and being disposed below the plurality of filters; and a reusable toner transfer device that transfers the reusable toner from the reusable toner container to the developing device so that the reusable toner is reused by the developing device, wherein the toner pooling portion includes a horizontal portion connected with a slant portion.

2. An image forming apparatus as claimed in claim 1, further comprising:

a foreign substance storing device that receives the foreign substance, said foreign substance storing device being disposed beside and below said plurality of filters, and being independently removable from the image forming apparatus.

3. An image forming apparatus as claimed in claim 1, wherein the plurality of filters incline downward to the foreign substance storing device.

4. An image forming apparatus as claimed in claim 1, wherein the reusable toner container includes a toner ejecting opening at a bottom portion thereof, which allows the reusable toner to be ejected.

5. An image forming apparatus as claimed in claim 4, wherein the bottom portion of the reusable toner container inclines downward towards the toner ejecting opening.

6. An image forming apparatus as claimed in claim 4, wherein the reusable toner transfer device includes a toner transferring member that receives the reusable toner ejected through said toner ejecting opening and transfers the reusable toner to the developing device.

7. An image forming apparatus as claimed in claim 1, further comprising a shaking device that shakes said plurality of filters in a widthwise direction thereof.

8. An image forming apparatus as claimed in claim 7, wherein the shaking device shakes said reusable toner container.

9. An image forming apparatus as claimed in claim 8, wherein the shaking device is driven by a driving member that drives the image carrier.

10. An image forming apparatus as claimed in claim 1, further comprising a toner pressing device that presses the used toner against at least one of the plurality of filters.

11. An image forming apparatus as claimed in claim 10, wherein the toner pressing device includes a toner pressing member that moves up and down, so as to press the used toner against at least one of the plurality of filters when moved downward.

12. An image forming apparatus as claimed in claim 11, wherein the toner pressing member includes a hollow cylinder and a cam that rotates and contacts an inner surface of the hollow cylinder, said hollow cylinder pressing the used toner when a shorter diameter of said cam contacts said inner surface.

13. An image forming apparatus, comprising:

means for carrying a latent image thereon;

means for developing said latent image with toner so as to form a toner image;

means for transferring the toner image onto a sheet;

means for removing used toner remaining on the image carrying means after the transferring means transfers the toner image;

means for separating reusable toner from a foreign substance blended in the used toner;

means for storing the reusable toner; and means for transferring the reusable toner to the developing means so that the reusable toner is reused by the developing means, wherein the reusable toner separating means includes:

a plurality of filters having a different sized mesh and positioned in a used toner stream in an order based on a roughness of the mesh, at least one of the plurality of filters including a toner pooling portion for pooling used toner and including a horizontal portion connected with a slant portion.

14. An image forming apparatus as claimed in claim 13, further comprising means for receiving the foreign substance, which is disposed beside and below said plurality of filters.

15. An image forming apparatus as claimed in claim 14, wherein the plurality of filters incline downward to said foreign substance storing means.

16. An image forming apparatus as claimed in claim 13, further comprising means for shaking said plurality of filters.

17. An image forming apparatus as claimed in claim 16, wherein the shaking means shakes the reusable toner storing means.

18. An image forming apparatus as claimed in claim 13, further comprising means for pressing the used toner against at least one filter of the plurality of filters.

19. A method of forming a toner image, comprising the steps of:

removing used toner remaining on an image carrier after a toner transfer process has completed;

separating reusable toner from a foreign substance blended in the used toner using a plurality filters;

storing the reusable toner in a reusable toner container;

transferring the reusable toner from said reusable toner container to a developing device; and reusing said reusable toner in said developing device, wherein the separating reusable toner step includes the steps of:

provisionally pooling the used toner in a toner pooling portion on at least one filter of the plurality of filters, and pressing the used toner against the at least one filter, and wherein the toner pooling portion includes a horizontal portion connected with a slant portion.

20. A method as claimed in claim 19, further comprising the step of shaking said filters during the separating reusable toner step.

21. A cleaning device for use in an image forming apparatus having a developing station and a toner recycling device, comprising:

a plurality of filters that separates reusable toner from a foreign substance blended in the used toner; and a reusable toner container that stores the reusable toner therein, which is to be transferred to the developing station by said toner recycling device, wherein the plurality of filters have a different mesh-size and are positioned in a used toner stream in an order based on the different mesh-size, and at least one of the plurality of filters has a toner pooling portion for provisionally pooling the used toner therein, and wherein the toner pooling portion includes a horizontal portion connected with a slant portion.

22. A cleaning device as claimed in claim 21, further comprising a foreign substance storing device that receives the foreign substance, which has not passed through the plurality of filters, and being disposed beside and below the plurality of filters.

23. A cleaning device as claimed in claim 22, wherein the foreign substance storing device is independently removable from the image forming apparatus.

24. A cleaning device as claimed in claim 22, wherein the plurality of filters incline downward to the foreign substance storing device.

25. A cleaning device as claimed in claim 21, wherein the reusable toner container includes a toner ejecting opening at a bottom portion thereof, which allows the reusable toner to be ejected.

26. An image forming apparatus as claimed in claim 25, wherein the bottom portion of the reusable toner container inclines downward towards the toner ejecting opening.

27. An image forming apparatus, comprising:

an image carrier that carries a latent image thereon;

a developing device that develops said latent image with toner so as to form a toner image;

a transfer device that transfers the toner image onto a sheet;

a cleaning device that removes used toner remaining on the image carrier after the transfer device transfers the toner image;

a plurality of inclined filters having a different mesh-size and positioned in a used toner stream in an order based on the different mesh-size, so that reusable toner is separated from a foreign substance blended in the used toner, and in which at least one filter of the plurality of filters includes a toner pooling portion that pools the used toner therein;

a reusable toner container that stores the reusable toner and being disposed below the plurality of filters; and a reusable toner transfer device that transfers the reusable toner from the reusable toner container to the developing device so that the reusable toner is reused by the developing device, wherein the reusable toner container includes a toner ejecting opening at a bottom portion thereof, which allows the reusable toner to be ejected, and wherein the bottom portion of the reusable toner container inclines downward towards the toner ejecting opening.

28. An image forming apparatus as claimed in claim 27, wherein the reusable toner transfer device includes a toner transferring member that receives the reusable toner ejected through said toner ejecting opening and transfers the reusable toner to the developing device.

29. An image forming apparatus, comprising:

an image carrier that carries a latent image thereon;

a developing device that develops said latent image with toner so as to form a toner image;

a transfer device that transfers the toner image onto a sheet;

a cleaning device that removes used toner remaining on the image carrier after the transfer device transfers the toner image;

a plurality of inclined filters having a different mesh-size and positioned in a used toner stream in an order based on the different mesh-size, so that reusable toner is separated from a foreign substance blended in the used toner, and in which at least one filter of the plurality of filters includes a toner pooling portion that pools the used toner therein;

a reusable toner container that stores the reusable toner and being disposed below the plurality of filters;

a reusable toner transfer device that transfers the reusable toner from the reusable toner container to the developing device so that the reusable toner is reused by the developing device; and a shaking device that shakes said plurality of filters in a widthwise direction thereof, wherein the shaking device shakes said reusable toner container.

30. An image forming apparatus as claimed in claim 29, wherein the shaking device is driven by a driving member that drives the image carrier.

31. An image forming apparatus, comprising:

an image carrier that carries a latent image thereon;

a developing device that develops said latent image with toner so as to form a toner image;

a transfer device that transfers the toner image onto a sheet;

a cleaning device that removes used toner remaining on the image carrier after the transfer device transfers the toner image;

a plurality of inclined filters having a different mesh-size and positioned in a used toner stream in an order based on the different mesh-size, so that reusable toner is separated from a foreign substance blended in the used toner, and in which at least one filter of the plurality of filters includes a toner pooling portion that pools the used toner therein;

a reusable toner container that stores the reusable toner and being disposed below the plurality of filters;

a reusable toner transfer device that transfers the reusable toner from the reusable toner container to the developing device so that the reusable toner is reused by the developing device; and a toner pressing device that presses the used toner against at least one of the plurality of filters, wherein the toner pressing device includes a toner pressing member that moves up and down, so as to press the used toner against at least one of the plurality of filters when moved downward.

32. An image forming apparatus as claimed in claim 31, wherein the toner pressing member includes a hollow cylinder and a cam that rotates and contacts an inner surface of the hollow cylinder, said hollow cylinder pressing the used toner when a shorter diameter of said cam contacts said inner surface.

33. An image forming apparatus, comprising:

means for carrying a latent image thereon;

means for developing said latent image with toner so as to form a toner image;

means for transferring the toner image onto a sheet;

means for removing used toner remaining on the image carrying means after the transferring means transfers the toner image;

means for separating reusable toner from a foreign substance blended in the used toner;

means for storing the reusable toner; and means for transferring the reusable toner to the developing means so that the reusable toner is reused by the developing means, wherein the reusable toner separating means includes:

a plurality of filters having a different sized mesh and positioned in a used toner stream in an order based on a roughness of the mesh, and means for pooling used toner thereon; and means for shaking said plurality of filters, wherein the shaking means shakes the reusable toner storing means.

34. A cleaning device for use in an image forming apparatus having a developing station and a toner recycling device, comprising:

a plurality of filters that separates reusable toner from a foreign substance blended in the used toner; and a reusable toner container that stores the reusable toner therein, which is to be transferred to the developing station by said toner recycling device, wherein the plurality of filters have a different mesh-size and are positioned in a used toner stream in an order based on the different mesh-size, and at least one of the plurality of filters has a toner pooling portion for provisionally pooling the used toner therein, wherein the reusable toner container includes a toner ejecting opening at a bottom portion thereof, which allows the reusable toner to be ejected, and wherein the bottom portion of the reusable toner container inclines downward towards the toner ejecting opening.

* * * * *